United States Patent [19]

Lilly

[11] Patent Number: 4,625,891

[45] Date of Patent: Dec. 2, 1986

[54] CONTAINER LID LOCK

[75] Inventor: Gerald C. Lilly, Wilmington, N.C.

[73] Assignee: Container Products Corp., Wilmington, N.C.

[21] Appl. No.: 811,353

[22] Filed: Dec. 20, 1985

[51] Int. Cl.[4] ..... B65D 45/00

[52] U.S. Cl. ..... 220/327

[58] Field of Search ..... 220/324, 327, 214; 292/253, 307 R

[56] References Cited

U.S. PATENT DOCUMENTS

| | | | |
|---|---|---|---|
| 3,187,929 | 6/1965 | Shaw, Jr. | 220/327 |
| 3,232,475 | 2/1966 | Taylor | 220/327 |
| 4,371,092 | 2/1983 | Teague | 220/324 |

*Primary Examiner*—George T. Hall

[57] ABSTRACT

A lock for the lid of a container used in disposing of low specific activity, minimally contaminated waste material, with the lock so constructed so as to be releasable or permanent, and to give visual indication of either condition. The lock structure includes a lid contacting member that may be releasably or permanently connected to a latch plate insertable into a restraining member carried by the side wall of the container.

8 Claims, 3 Drawing Figures

CONTAINER LID LOCK

PRIOR ART DISCLOSURES

This invention is an improvement over the lid hold down assembly shown and described and claimed in the U.S. Pat. No. 4,371,092.

In prior devices before this invention, the waste container lid lock could only be used as a lasting permanent closure means. Normally once locked the container was of no further service, even after a period of time during which the waste therein further compressed leaving a void within the container. As capacity of such contaminated waste disposal containers is critical and disposal sites are limited it is imperative to maximize the capacity of the containers.

SUMMARY OF THE INVENTION

An object of this invention is to provide a contaminated waste disposal container with a lid lock that is capable of being temporarily, yet securely, closed and latched or permanently latched, while giving visual indication as to which condition it is in.

The container lid lock of this invention is suitable for use on disposal containers which are generally rectangularly in shape so as to maximize the volume/cubic space displacement ratio, thus producing pronounced advantages in storage, transportation and capactiy.

To achieve the objects of this invention the container lid locks include a series of stirrups fixedly attached to the outer wall surfaces of the container adjacent to its exposed top edges. For each stirrup there is a locking member consisting of an elongated metal bar having a long depending leg adapted to be positioned into a corresponding stirrup, and a short upper run adapted to project above the lid for the container when the latter is placed thereon.

The long depending leg of the lock provides on one outer surface a retaining member that is designed to be forcefully projected beneath the bottom edge of the stirrup so as to prevent its withdrawal therefrom.

Carried by the short upper run of the locking member is an angled brace which when the long leg is inserted and latched in the stirrup, will bear upon the lid and secure the same in place. This angled brace may be bolted to the upper run of the lock so as to be released therefrom and removed from its bearing position upon the lid of the container. This construction would permit selective reopening of the container for further deposit of contaminated wastes therein. When the full capacity of the container is reached the attachment between the brace and the upper run of the lock can be made permanent by welding of the parts or by swedging of the connecting members.

BRIEF DESCRIPTION OF THE DRAWINGS

The invention will best understood by reference to the accompanying drawings showing the preferred form of construction and mode of operation of the invention and in which.

GENERAL DESCRIPTION

Figure 1:
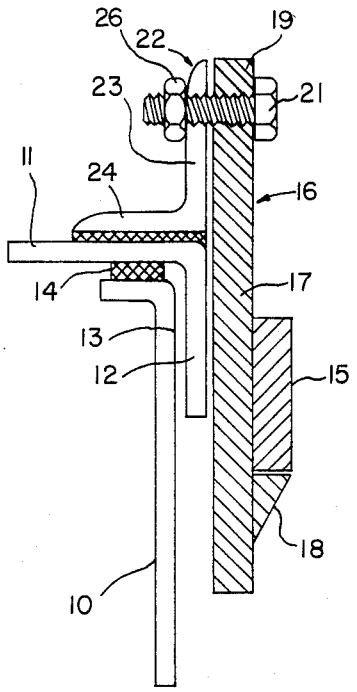
FIG. 1 is a side elevational detailed sectional view of the lid lock of this invention.
Figure 2:
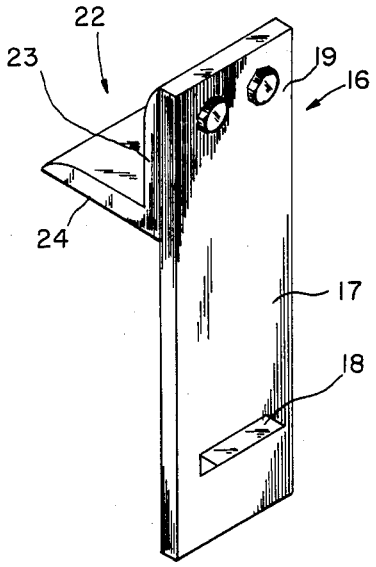
FIG. 2 is a prespective view of the lid lock and FIG. 3 is a perspective view of the lid lock with portions thereof in exploded relation and with the stirrup fragmentarily shown sectionally.
Figure 3:
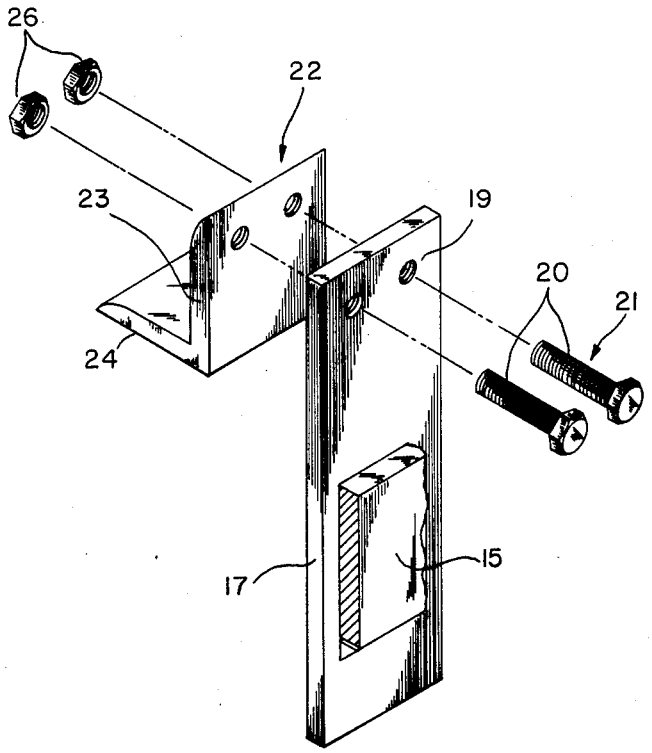

In FIG. 1 there is shown in section one vertical wall 10 of a waste disposal container. A lid 11 is fragmentarily shown and it provides a depending flange 12 that overlies the exposed peripheral edge 13 of the container wall 10. A sealing gasket 14 is positioned therebetween.

Attached to the outer surface of the wall 10 beneath but adjacent to its exposed peripheral edge 13 is a stirrup 15. This stirrup 15 is so positioned so as to present a vertical opening extending parallel to the wall 10. A plurality of stirrups 15 may be attached to all of the walls of the container for a purpose hereinafter made apparent.

A lid latch piece 16 is constructed from a single rectangularly shaped metal bar and provides a depending leg portion 17 of a length sufficient to extend beyond the lower edge of the lip flange 12 when it is disposed in a parallel relation to the wall 10 of the container. This depending leg 17 of the latch piece 16 is of a width less than the width of the opening provided by the stirrup 15 so as to be easily projected through the stirrup 15 as shown in FIG. 1.

Carried by the depending leg 17 of the latch piece 16 is a restraining member 18 that extends transverse to the length of the leg 17. Thus when the latch piece 16 is inserted through the stirrup 15, the restraining member 17 will be forced beneath the bottom edge 19 of the stirrup 15, and restrain the latch pin from upward movement through the sturrup 15.

A short upper run 19 is provided at the top of the latch piece 16 and is adapted to extend above the horizontal plane of the lid 11 when the leg 17 of the latch piece 16 is projected into the stirrup 15. A set of apertures are formed in the upper run 19 and are adapted to receive the shanks 20 of connecting bolts 21.

A hold down brace 22, in the form of an angle iron is provided, with one leg 23 thereof of a length equal to the upper run 19 of the latch piece 16. The right angled leg 24 of the brace 22 is of a length to extend over an edge portion of the lid 11 and is adapted to sit thereon, as illustrated in FIG. 1, when the brace 22 is connected to the latch piece 16. This connection is obtained when the shanks 20 of the connecting bolts 21 are projected through apertures 25 formed in the brace 22 and held in place by nuts 26.

Thus when the lid 11 is placed in a closure posture upon the container and the latch piece 16 is mounted in the stirrup 15, the brace 22 carried by the upper run 19 of the latch piece 16, will contact the lid 11 and secure the same onto the container.

A container lid lock as hereinbefore described may be used as a permanent lock or one that can be released so as to permit removal of the lid from the container.

It has been found that the initial deposit of disposable wastes will compact and leave a void in the container. This void can be filled only in the event that the lid may be removed. As the hold down brace 22 is initially secured in its lid locking position when it is connected by the bolts 21 to the upper run 19 of the latch piece 16 it is evident that by removal of the bolts 21, the brace 22 is released from the latch piece 16 such that the latter no longer is restrained in the stirrup 15. When the container is filled to capacity and the latch piece 16 and brace 22 are in locking relationship, the brace 22 can be welded to the upper run or the connecting bolts 21 may have their ends disfigured so as to prevent the removal of the nuts 26 therefrom. By either means the lid may be permanently locked into place and can only be opened by physical destruction of the lock, which in turn would give visual indication of such condition.

While I have illustrated and described the preferred form of construction for carrying my invention into effect, this is capable of variation and modification without departing from the spirit of the invention. I therefore, do not wish to be limited to the precise details of construction as set forth, but desire to avail myself of such variations and modifications as come within the scope of the appended claims.

Having thus described my invention, what I claim as new and desire to protect by Letters Patent is:

1. An assembly for securing a lid upon a disposable waste container comprising;

(a) a retaining bracket mounted on the exposed wall surfaces of the waste container adjacent to the open top thereof, (b) an elongated latch piece having a first depending portion insertable within said bracket and extending in facial abutment with the adjacent side wall of the container, (c) said latch piece providing a second portion extending vertically above the open top edge of the container to a point above the lid when it is placed on the container, (d) a latching brace attached to said second portion of said latch piece and in contact with the lid when the same is placed in a closing position upon the container for latching the lid in place, and (e) means carried by said first portion of said latch piece providing an interlock between said latch piece and said retaining bracket for securing said latch piece within said retaining bracket when the lid is placed upon the open top of the waste container and held thereon by said brace.

2. An assembly for securing a lid upon a disposable waste container as defined by claim 1 wherein said latching brace is an angle iron, one leg of which is attached to said second portion of said latch piece, and with its remaining leg extending over and in contact with the top surface of the lid.

3. An assembly for securing a lid upon a disposable waste container as defined by claim 1 wherein said retaining bracket is a stirrup providing an opening through which said first depending portion of said latch piece projects.

4. An assembly for securing a lid upon a disposable waste container as defined by claim 3 wherein said latching brace is an angle iron, one leg of which is attached to said second portion of said latch piece, and with its remaining leg exgending over and in contact with the top surface of the lid.

5. An assembly for securing a lid upon a disposable waste container as defined by claim 1 including means for attaching said latching brace to said second portion of said latch piece.

6. An assembly for securing a lid upon a disposable waste container as defined by claim 5 wherein said latching brace is an angle iron, one leg of which is attached to said second portion of said latch piece, and with its remaining leg extending over and in contact with the top surface of the lid.

7. An assembly for securing a lid upon a disposable waste container as defined by claim 5 wherein said retaining bracket is a stirrup providing an opening through which said first depending portion of said latch piece projects.

8. An assembly for securing a lid upon a disposable waste container as defined by claim 4 including means for attaching said one leg of said angle iron to said second portion of said latch piece.

* * * * *